US006795773B2

(12) United States Patent
Soliman et al.

(10) Patent No.: US 6,795,773 B2
(45) Date of Patent: Sep. 21, 2004

(54) WELL COMPLETION METHOD, INCLUDING INTEGRATED APPROACH FOR FRACTURE OPTIMIZATION

(75) Inventors: Mohamed Y. Soliman, Plano, TX (US); Audis C. Byrd, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/949,448

(22) Filed: Sep. 7, 2001

(65) Prior Publication Data

US 2003/0050758 A1 Mar. 13, 2003

(51) Int. Cl.[7] ..... G06F 19/00; E21B 47/00

(52) U.S. Cl. ..... 702/6; 166/250.1

(58) Field of Search ..... 702/6, 12; 166/250.1, 166/250.08; 73/152.39; 703/9, 5, 1, 10

(56) References Cited

U.S. PATENT DOCUMENTS

| | | | | | |
|---|---|---|---|---|---|
| 3,727,688 | A | * | 4/1973 | Clampitt | 166/283 |
| 4,828,028 | A | | 5/1989 | Soliman | 166/250 |
| 4,836,284 | A | * | 6/1989 | Tinker | 166/279 |
| 4,848,467 | A | * | 7/1989 | Cantu et al. | 166/281 |
| 5,103,905 | A | * | 4/1992 | Brannon et al. | 166/250.1 |
| 5,183,109 | A | * | 2/1993 | Poulsen | 166/250.1 |
| 5,217,074 | A | * | 6/1993 | McDougall et al. | 166/300 |
| 5,325,921 | A | * | 7/1994 | Johnson et al. | 166/280.1 |
| 5,558,161 | A | * | 9/1996 | Vitthal et al. | 166/280.1 |
| 5,743,334 | A | * | 4/1998 | Nelson | 166/250.07 |
| 6,002,985 | A | * | 12/1999 | Stephenson | 702/13 |
| 6,012,016 | A | | 1/2000 | Bilden et al. | 702/12 |
| 6,076,046 | A | * | 6/2000 | Vasudevan et al. | 702/12 |
| 6,364,015 | B1 | * | 4/2002 | Upchurch | 166/250.1 |
| 6,439,310 | B1 | * | 8/2002 | Scott et al. | 166/308.1 |

OTHER PUBLICATIONS

"Intelligent Systems Can Design Optimum Fracturing Jobs", Mohaghegh et al., Society of Petroleum Engineers, SPE 57433, Oct. 21–22, 1999.*

"Fractured reservoir Characterization Using Streamline–Based Inverse Modeling and Artifical Intelligence Tools", Barman et al., Society of Petroleum Engineers, SPE 63067, Oct. 1–4, 2000.*

"A Hybrid Neuro–Genetic Approach to Hydraulic fracture Treatment Design and Optimization", Mohaghegh et al., Society of Petroleum Engineers, SPE 36602, Oct. 6–9, 1996.*

"Integrated Fractured reservoir Modeling Using Both Discrete and Continuum Approaches", Ouenes et al., Society of Petroleum Engineers, SPE 62939, Oct. 1–4, 2000.*

Perkins, T. K. and Kern, L. R.: "Widths of Hydraulic Fractures," *Journal of Petroleum Technolgy*, Sep., 1961, pp. 937–949.

(List continued on next page.)

*Primary Examiner*—John Barlow
*Assistant Examiner*—Toan M. Le
(74) *Attorney, Agent, or Firm*—Robert A. Kent; E. Harry Gilbert, III

(57) ABSTRACT

Fracture design for well completion includes determining a conductivity profile for the given reservoir to be fractured. Materials needed to obtain this conductivity profile are selected based on their ability to meet the conductivity objective and their rank based on economic value. A further step gives the designer a pumping schedule to be performed on the surface after an initial test in the actual well. This can reduce the iterations required to optimize a fracturing treatment and significantly reduce the redesign process at the well site.

5 Claims, 7 Drawing Sheets

OTHER PUBLICATIONS

Ramey, Jr., H. J., "Wellbore Heat Transmission," *Journal of Petroleum Technology*, Apr., 1962, pp. 427–435.

Wooley, Gary, R., "Computing Downhole Temperature in Petroleum and Geothermal Wells," SPE 8441, presented at the 54$^{th}$ Annual Fall Technical Conference and Exhibition of the Society of Petroleum Engineers of AIME, held at Las Vegas, Nevada, Sep. 1979.

Wheeler, J. A., "Analytical Calculations for Heat Transfer from Fractures," SPE 2494 (1969).

Kamphius, H., Davies, D. R. and Roodhart, L. P., "A New Simulator for the Calculation of the In–Situ Temperature Profile During Well Stimulation Fracturing Treatments," Paper No. CIM/SPE 90–46, presented at the International Technical Meeting jointly hosted by the Pertoleum Society of CIM and the Society of Petroleum Engineers in Calgary, Jun. 1990.

Nolte, Kenneth G., "Fluid Flow Considerations in Hydraulic Fracturing," SPE 18537, prepared for presentation at the SPE Eastern Regional Meeting in Charleston, West Virginia, Nov. 1988.

Leal, L. G., "Particle Motions in a Viscous Fluid," *Ann. Rev. Fluid Mech.* (1980), 12:435–76.

Cleary, M. P. and Fonseca, Jr., Amaury, "Proppant Convection and Encapsulation in Hydraulic Fracturing: Practical Implications of Computer and Laboratory Simulations," SPE 24825, prepared for presentation at the 67$^{th}$ Annual Technical Conference and Exhibition of the Society of Petroleum Engineers held in Washington, D.C., Oct. 1992.

Pearson, J.R.A., "On Suspension Transport in a Fracture: Framework for a Global Model," *Journal of Non–Newtonian Fluid Mechanics* 54 (1994) 503–513.

Economides, M. J. and Nolte, K. G., "Reservoir Simulation 3$^{rd}$ Edition," John Wiley and Sons, LTD (2000), pp. 8–18 through 8–23.

Mobbs, A. T. and Hammond, P. S., "Computer Simulations of Proppant Transport in a Hydraulic Fracture," *SPE Production & Facilities*, May 2001, pp. 112–121.

Soliman, M.Y. and Hunt, J.L., "SPE 14514—Effect of Fracturing Fluid and Its Cleanup on Well Performance," Society of Petroleum Engineers, 12 pp. (1985).

Soliman, Mohamed, "Fracture Conductivity Distribution Studied," Technolgy—Oil & Gas Journal, pp. 89–93 (Feb. 10, 1986).

Poulsen, D.K. and Soliman, M.Y., "SPE 15940—A Procedure for Optimal Hydraulic Fracturing Treatment Design," Society of Petroleum Engineers, 8 pp. (1986).

"Experience Proves Forced Fracture Closure Works" by John W. Ely in the World Oil Published in Jan. 1996.

"Horizontal Well will be Employed in Hydraulic Fracturing Reasearch" published in the Oil & Gas Journal on May 20, 1991.

* cited by examiner

WELL COMPLETION METHOD, INCLUDING INTEGRATED APPROACH FOR FRACTURE OPTIMIZATION

BACKGROUND OF THE INVENTION

This invention relates generally to well completion methods and more particularly to methods of defining fracturing treatments for oil or gas wells.

In completing an oil or gas well after the wellbore has been drilled, a procedure referred to as "fracturing" may be performed to enhance the productivity of the well. Fracturing in essence creates in the oil or gas-bearing formation an enhanced conductive path through which the oil or gas can flow more readily than through the unfractured formation rock itself.

Although fracturing may increase oil or gas flow from the formation into the wellbore, achieving this result may not be economically efficient if the cost of fracturing is more than the revenue that will be obtained from the increased production. Even if a fracturing process is economical for a particular well, the design of the fracturing job should be carefully made to ensure its success. The advent of the Three Dimensional Fracture Simulators (3-D) has helped optimize fracture treatments by predicting fracture growth in height. This has shown that many times the fracture grows out of the desired formation and thus reduces the effectiveness of the fracture treatment. This 3-D growth is key to fracture optimization and can be used to determine when the fracturing process is no longer achieving the fracture length growth and thus reducing the economic impact of the treatment.

A traditional way of creating a fracturing treatment design has depended upon the ability of a skilled person to select a fracturing fluid with which to hydraulically fracture the formation and a proppant which is to be carried into the fracture by the fracturing fluid and left there to prop the fracture open after the hydraulic pressure is released. The details and quality of a particular design of such a fluid system have depended upon the knowledge and experience of this person. Typically, that knowledge and experience are applied to select a fracturing fluid and proppant with whatever factors the individual designer has come to rely on. Maybe more than one such design is conceived, and maybe the designs are tested in a fracture modeling simulator to see what the simulator projects will be the resultant fracture for each of the designs. Economic analyses can be made for the various simulations using, for example, return on investment (ROI) or net present value (NPV) from a reservoir simulation of production results from each proposed treatment and cost of the treatment. From these cost versus production analyses, one of the designs is selected and used in controlling the pumping of the selected fracturing fluid and proppant into the well. If the skilled individual is at the well site during the fracturing treatment or otherwise in real-time communication, changes to the design might be made "on-the-fly" based on conditions that are monitored during the fracturing job.

One shortcoming of the aforementioned traditional technique for designing a fracturing job is that it significantly depends on the individual skill of the person who is designing the treatment schedule for the job. Thus, each fracturing job to be performed in this manner depends on the availability and ability of a particular person. This limits the design by a person's own shortcomings, and it hinders the transfer of knowledge gained from one area/formation into other areas or formations. This approach does not necessarily mean that the "optimum" fracturing treatment has been designed and delivered. One has to realize that the optimum treatment does not necessarily mean the largest. This type of approach also can provide a myriad of different possible designs to be analyzed by the simulator and economic factors.

In view of at least the foregoing shortcomings, there is a need in the well completion field, and specifically the fracture treatment design field, to reduce the dependency on specific individuals with unique knowledge, experience and ability; however, there is also the need to make such expertise more widely available so that it can be used consistently for more wells. There is also the need for a design technique that more easily arrives at one or more possible solutions than may be required for a human to directly create such design. There is also the need to arrive at possible fracturing treatment solutions based on actual well data and consistent, predetermined analytical factors. There is also the need to provide the ability to optimize a design, including economic optimization. Towards this goal we need to apply the knowledge gained through theory in a practical fashion reaching the right mix of sound fundamental work and field gained experience.

SUMMARY OF THE INVENTION

The present invention overcomes the above-noted and other shortcomings of the prior art and meets the aforementioned needs by providing a novel and improved optimization process for well completions in general and for fracturing treatments in particular. This process is to optimize the materials used (fluid, proppant, breakers, etc.) in the fracturing treatment as well as the height, length and width of the fracture to achieve the optimized fracture treatment based on the desired economic drivers. The stresses within the oil or gas bearing formation as well as the surrounding formations control the geometry of the fracture created. These stresses will determine the geometry of the fracture and can be modeled in a 3-D fracture simulator (FracPro®, FracProPT™, StimPlan™, M-Frac™, etc.) and this geometry is key to optimizing the fracture treatment.

Instead of starting with various fracturing materials based on some individual's personal knowledge or preferences and running simulations and economic analyses to project possible resulting production and cost, the present invention starts by determining a conductivity profile (preferably an optimum one) for the given reservoir to be fractured. Once the conductivity profile, for a constant pressure drop down the fracture, is determined for the given reservoir conditions, along with any other losses like multi-phase flow or gel damage, the materials needed to obtain this conductivity profile are determined by the respective material's performance and economics. The materials selected are based on their ability to meet the conductivity objective and their rank based on economic value to the fracture conductivity objective (for example, proppant judged on strength and cost/conductivity for given reservoir conditions, stress, temperature, etc.). In this way unsuitable materials are eliminated early in the analysis so that the materials to evaluate in the desired design are only those capable of achieving the final conductivity goal in an economical manner. Whereas a prior approach might result in a very large number of combinations of materials to evaluate to achieve the desired results by trial and error, the new approach of the present invention significantly reduces the combinations of materials for the design process and ensures that the materials in the evaluation process are only those that should be considered for the reservoir conditions. This ensures that the final simulations use the technically appropriate materials and are the best value materials for the desired conductivity objectives. The theoretical length desired for the formation to be stimulated should be verified by 3-D simulation for height, length and width before the appropriate materials are selected and the preferably optimized fracture geometry determined.

Adding a further step in the new approach of the present invention gives the designer a pumping schedule to be performed on the surface after an initial test in the actual well. This differs from the old approach in which a pumping schedule is first prepared and pumping of the job begun and then evaluated as to how close the pumping schedule comes to producing the desired conductivity profile needed for the reservoir conditions. Waiting until after a test is run on the actual well to provide a pumping schedule as done in the present invention is a significant change because changes in assumptions may need to be made after test data is obtained from the well, such as data from a mini-frac process. When the mini-frac data is matched in the 3-D fracture simulator by changes in reservoir parameters (stress, fluid leakoff, etc.) will affect the fracture geometry predictions and result in a new pumping schedule to optimize the pumping schedule for the materials available for the fracturing treatment. Once this data is obtained, the invention can produce the appropriate pumping schedule based on the new well parameters instead of running simulations for multiple pumping schedules to determine which comes closest to the desired conductivity profile. This new approach can reduce the iterations required to optimize a fracturing treatment and significantly reduce the redesign process at the well site.

Accordingly, the present invention can be defined as a computer-aided well completion method, comprising: performing tests on a subterranean well to obtain data about physical properties of at least one earthen formation traversed by the well, and entering the data into a computer; determining, in the computer and in response to the data, an initial desired fracture length and conductivity for a fracture to be formed in at least one earthen formation traversed by the well; determining, in the computer and in response to the data and the initial desired fracture length and conductivity, a proppant and a fracturing fluid proposed to be pumped into the well to fracture the earthen formation; determining, in the computer, a treatment schedule for pumping the fluid and the proppant into the well; and pumping fluid and proppant into the well in accordance with at least part of the treatment schedule. This method can further comprise: measuring, in real time while pumping fluid and proppant, downhole parameters in the well; modifying, in the computer and in response to the measured downhole parameters, the treatment schedule; and continuing the pumping of fluid and proppant in accordance with the modified treatment schedule. The first-mentioned pumping fluid and proppant can be performed as part of performing a mini-frac job on the well. The determining steps can be performed using any suitable digital computer, including those that perform neural network processing. Preferably, determining the treatment schedule includes performing in the computer an economics analysis of projected resulting production versus a projected cost of performing the treatment.

Another definition of the present invention is as a method of completing a well to provide a desired hydrocarbon productivity, comprising: logging the well to obtain data used in measuring physical and mechanical properties of a subterranean formation traversed by the well; entering the data into a computer; using the data and predetermined production increase curves encoded into signals stored in the computer, defining in the computer a desired fracture length; determining, in the computer and in response to entered data, an expected fracture width; determining, in the computer and in response to the desired fracture length and expected fracture width, a desired proppant deposition; determining, in the computer and in response to predetermined data stored in the computer, a required proppant concentration; determining, in the computer and in response to entered data, a temperature in the well; determining, in the computer and in response to the determined temperature, a fracturing fluid to be pumped into the well for fracturing; running, in the computer, a reservoir simulation program and an economics model program using the determined proppant and fluid to determine a desired treatment schedule for pumping fluid and proppant into the well; and pumping fluid and proppant into the well in accordance with the treatment schedule. This can further comprise obtaining further data about the well while pumping fluid and proppant, and modifying the treatment schedule in real time so that the pumping continues in accordance with the modified treatment schedule.

Still another definition of the present invention is as a method of defining a fracturing treatment for a well, comprising: storing physical property data about a selected well in a computer also having stored therein data defining predetermined production increase relationships and predetermined proppant deposition and concentration relationships; operating the computer to automatically output, in response to the physical property data and the data defining production increase relationships and predetermined proppant deposition and concentration relationships, data defining a proposed fracture treatment schedule including a proposed proppant and fluid system; testing the proposed fracture treatment schedule in a fracture modeling program stored in the computer; and performing in the computer an economic analysis of the proposed fracture treatment schedule. This can further comprise: repeating the steps of operating, testing and performing with regard to defining at least one other fracture treatment schedule; and selecting one of the fracture treatment schedules to guide a fracturing treatment applied to the selected well.

Therefore, from the foregoing, it is a general object of the present invention to provide a novel and improved method for well completion or fracture optimization. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a portion of the graphs of FIG. 4 for a well permeability of 100 millidarcy and a hole diameter of 8 inches.

FIG. 8 contains conductivity versus stress graphs for the different proppants identified in FIG. 7.

FIG. 9 contains proppant deposition versus proppant concentration information for fractures having different widths.

DETAILED DESCRIPTION OF THE INVENTION

The well completion method and method of defining a fracturing treatment for a well of the present invention are of the type in which (1) information relating to the particular well to be fractured deemed necessary to the determination of the fracturing treatment is obtained and entered into a computer, and (2) the computer outputs one or more treatment schedules, preferably using optimization criteria gained through both theory and practice. To complete the well, a selected one of the schedules is used to initiate a fracturing job on the well.

Figure 1:
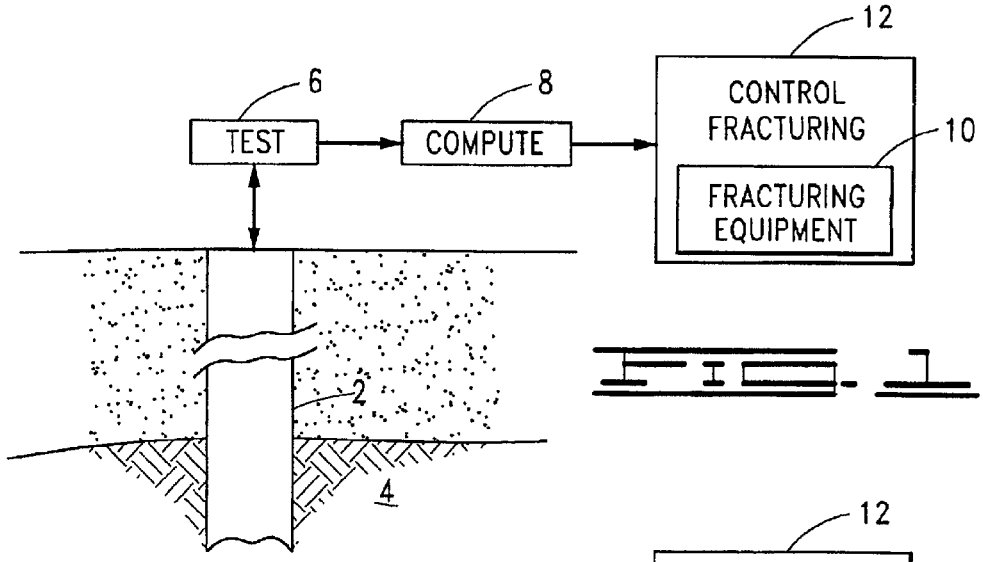
FIG. 1 is a schematic and block diagram of a well with which the present invention can be used in completing the well.

Referring to FIG. 1, a wellbore 2 has been drilled in any suitable manner. The wellbore 2 intersects at least one subterranean oil- or gas-bearing formation 4. To enhance production from the formation 4 into the wellbore 2 and on to the surface in an economical manner, a fracturing job is to be performed in accordance with the present invention. This present invention includes obtaining data about the well, such as by performing tests 6 on the well, using the data to compute a desired fracturing treatment schedule as indicated at 8 in FIG. 1, and controlling fracturing equipment 10 and the fracturing process in accordance with the treatment schedule as indicated at 12 in FIG. 1. More specifically, this well completion method comprises determining a conductivity profile for the well to be completed; then in response to determining the conductivity profile, selecting materials to pump into the well to fracture the well; and pumping the selected materials into the well to fracture the well.

The equipment represented in FIG. 1 (and likewise in FIGS. 2 and 3) is conventional except that the computer(s) used are programmed in accordance with the present invention. At this time the best computer to be used is a personal computer (PC). Other workstations may be applicable. In the future, hand held computers may be used either for the full application or in a diluted version of the invention.

Figure 2:
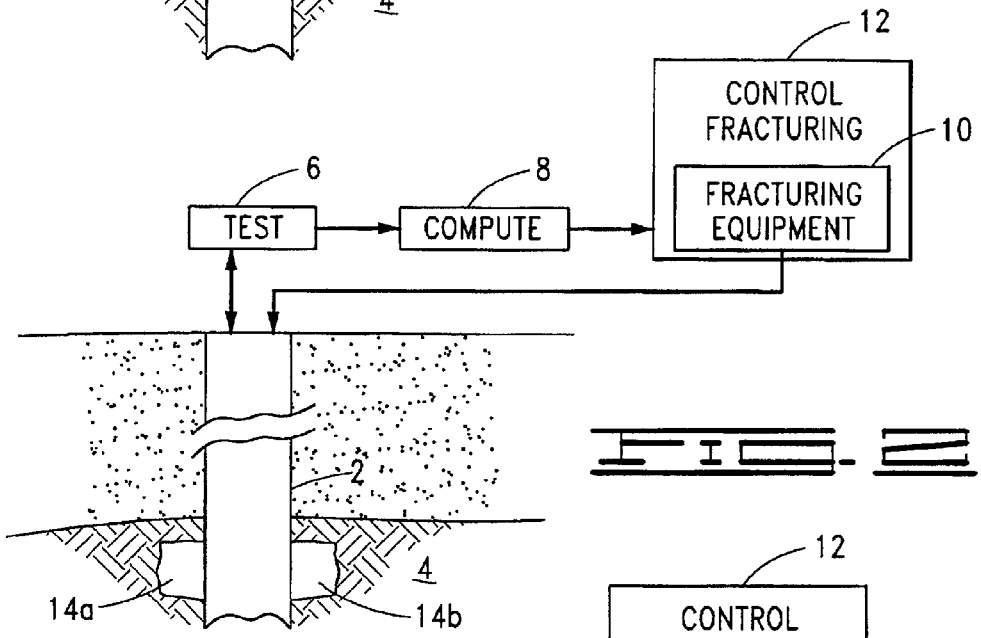
FIG. 2 is the diagram of FIG. 1 but also showing the beginnings of a fracture formed using the present invention.

Referring to FIG. 2, the treatment schedule has been used to control the fracturing equipment 10 and process 12 such that a fracture 14 begins to form. In FIG. 2 the fracture 14 is shown as extending from both ends of a diameter of the wellbore 2 as represented schematically at 14*a*, 14*b* in the drawing. For a symmetrical fracture, the length of one of the fracture wings (segments) 14*a* or 14*b* is only half the total length of the fracture; but such half-length is commonly called the fracture length or fracture half-length with both terms meaning the same thing. It is accepted practice to assume that the fracture growth is equal in both directions from the wellbore even though such symmetry is not always the case; and thus the design model only has to model one-half of the total fracture, thereby reducing the computations.

Figure 3:
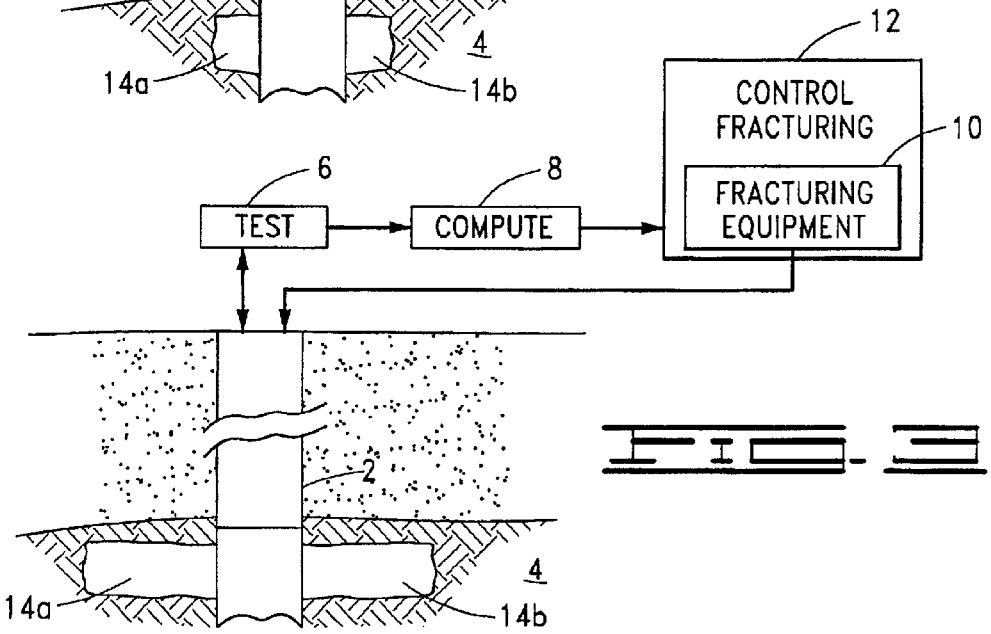
FIG. 3 is the representation of FIG. 2 but further showing a later stage of the fracture.

Referring to FIG. 3, preferably at least some of the testing 6 continues during the initiated fracturing job and at least some of the computing continues based on the new, real-time test data obtained from the testing 6 so that the original selected treatment schedule can be confirmed if the fracture is forming as desired or modified as needed to obtain the desired fracture. Regardless whether testing continues, as the fracturing job proceeds the fracture 14 is extended as indicated in FIG. 3.

The foregoing will now be described in more detail in the context of defining a fracturing treatment for a well undergoing completion.

The integrated computer-aided design and completion approach of the present invention preferably includes at least three steps, and also preferably at least a fourth step as well. The goal of the first step is to calculate the parameters of an approximately optimized fracture using a simple graphical and equation approach encoded to be used in a digital computer as described above. This step includes selecting initial fracture parameters. This step also provides an initial completion design to be optimized in the next steps. The second step involves a comprehensive approach to optimizing fracture design by selecting the most economic design. The initial design of step 1 is the starting point of the optimization process of step 2. Step 3 includes adjusting the model parameters on location using real data from the subject well to create an optimized treatment schedule for fluid and proppant available on location at the time of treatment. The fourth step is the inclusion of risk analysis in this optimization process. This fourth step is an optional one that could put another quantitative measure to the optimized design. Each of these steps will be described in more detail in the following sections. These four steps may be based on or implemented with computational algorithms, or they may be based on neural network algorithms. The neural network algorithm accurately mimics the behavior of the various computational algorithms such as fracture geometry calculation.

To Obtain an Initial Design

1. Log the well to determine physical and mechanical properties of the formation. The physical properties may include, for example, permeability, porosity, type of the fluid and fluid saturation. The physical properties are usually obtained from a combination of logs such as gamma ray, density, sonic, electric, and pulse neutron logs. The mechanical properties include Young's Modulus and Poisson's Ratio. The stress field may also be determined, including in-situ stresses at different height locations. Logs such as long spaced sonic and dipole sonic may be used for this task. If a MRIL tool is used, the list of parameters may also include irreducible fluid saturation, hydrocarbon and water permeability. The MRIL log gives a strong indication of the grain size and distribution and in some cases clay content. Whatever parameters are selected, they are encoded for use in a digital computer.

2. Using the measured and calculated formation parameters, the formation as represented within the computer may be divided into zones from a fracturability point of view. This is usually done based on the calculated or measured in-situ stress.

Figure 4:
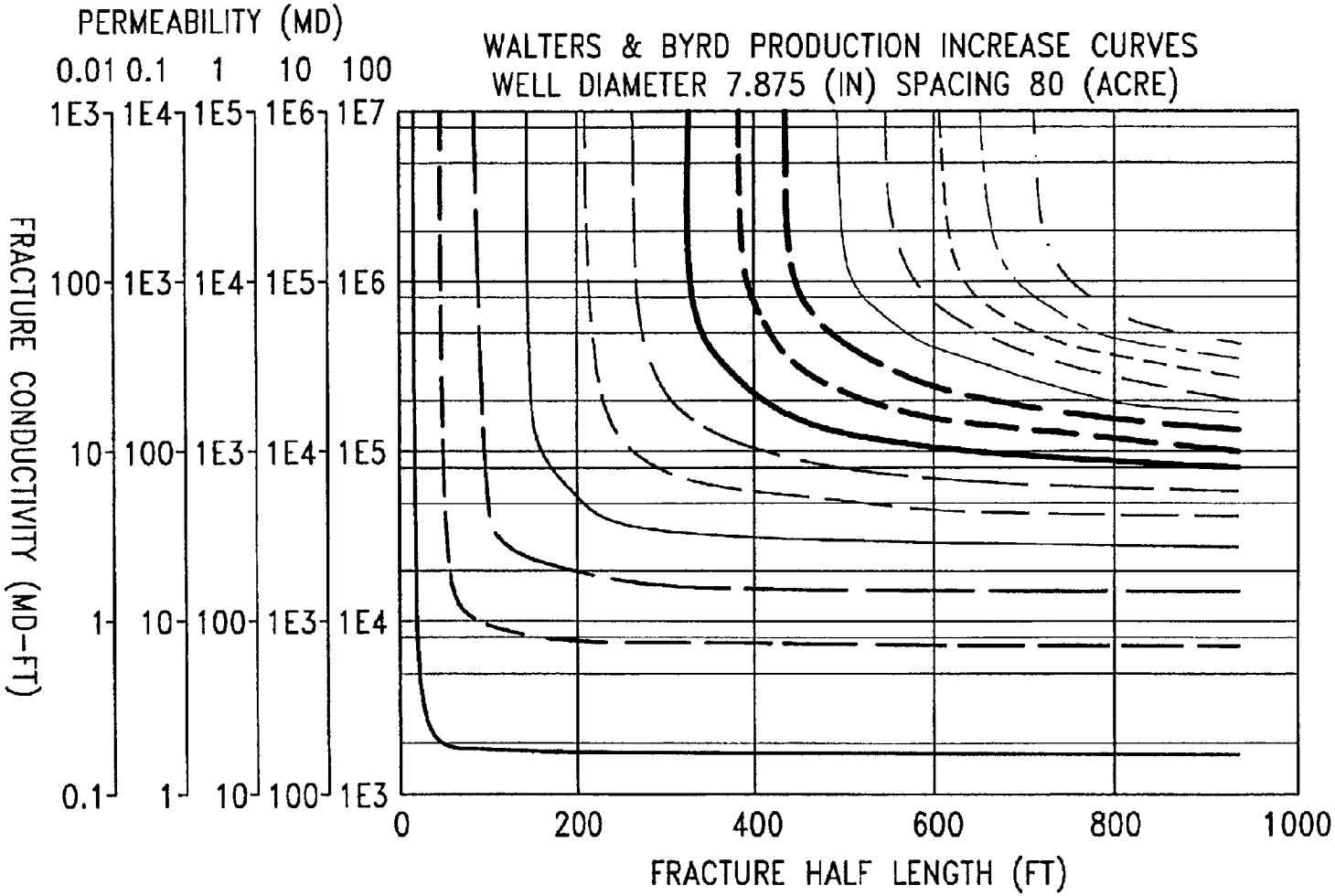
FIG. 4 is an example of Walters & Byrd production increase curves.

3. Using digitally encoded signals representing the properties of the formation and a production increase curve such as the one produced by Walters and Byrd (a graphical example is shown in FIG. 4), one may quickly develop a limit on fracture design parameters. It is possible to use other production increase curves, such as disclosed in Soliman, M. Y.: "Fracture Conductivity Distribution Studied," *Oil & Gas Journal* (Feb. 10, 1986), which is incorporated herein by reference. Unsteady state production increase calculations may be also used.

Figure 5:
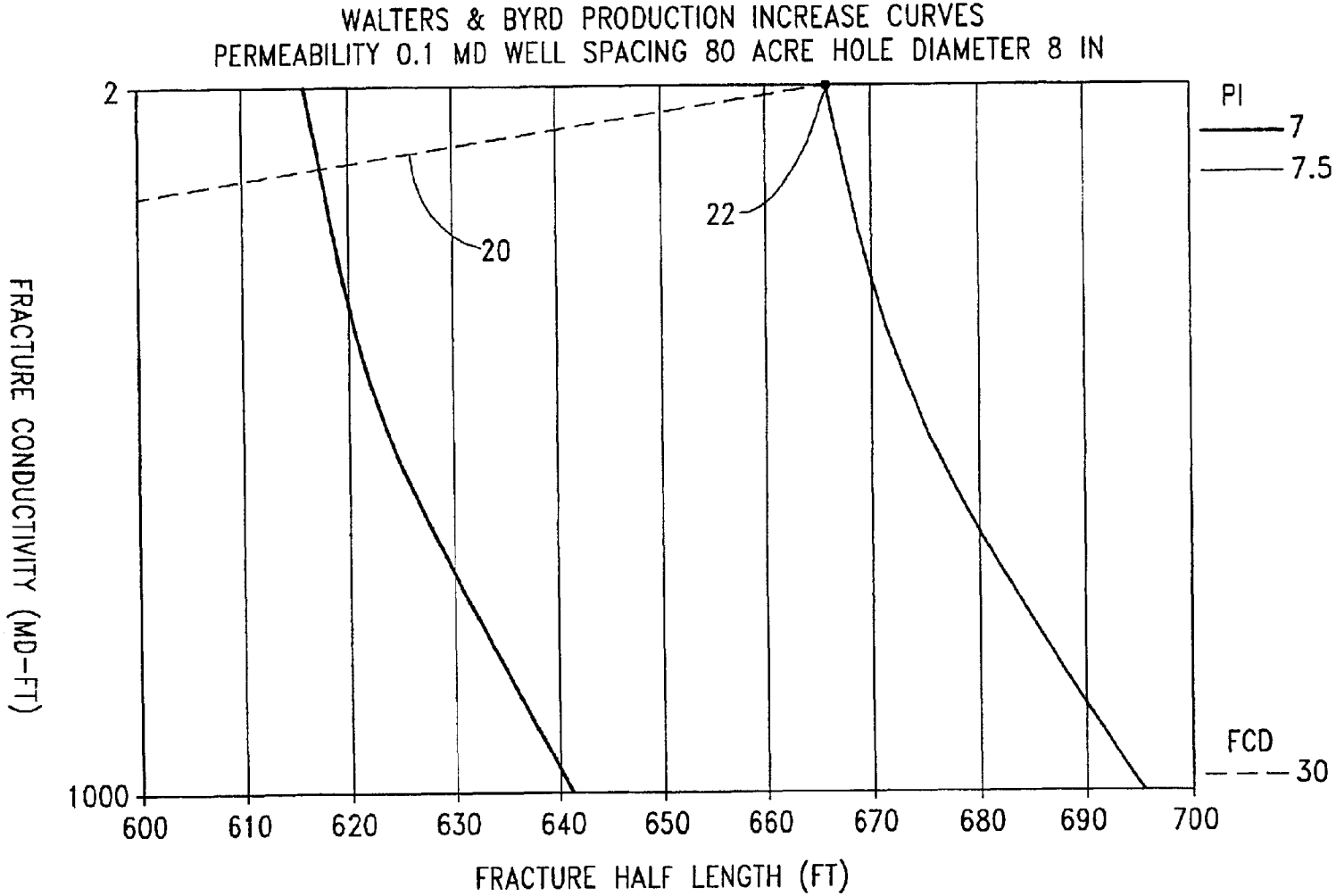
FIG. 5 is an enlargement of part of the graphs of FIG. 4 for a well permeability of 0.1 millidarcy and a hole diameter of 8 inches.
Figure 5:
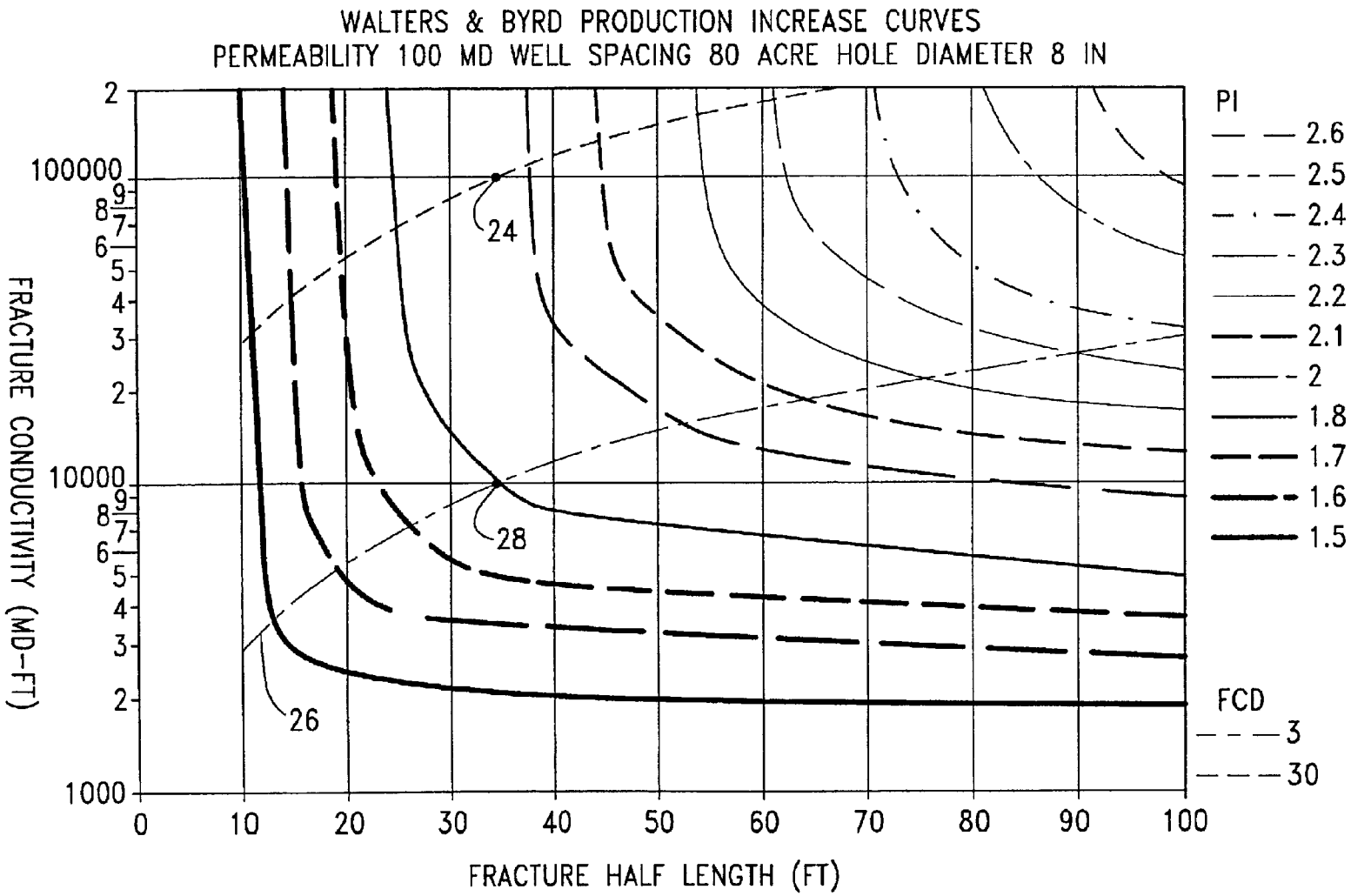

For illustration of this for steady state conditions, curves developed by Walters and Byrd will be used. The production increase curves are dependent on formation permeability, fracture length, fracture conductivity, drainage area, and wellbore diameter. For example, if one is to stimulate a formation with a permeability of only 0.1 millidarcy (md), the graph of FIG. 4 (and more clearly in the expanded section shown in FIG. 5) reveals that a fairly long fracture with conductivity of 1,000 millidarcy-feet (md-ft) may be beneficial. To allow for an efficient fracture clean up, a dimensionless fracture length approaching 30 is usually recommended. See Soliman, M. Y. and Hunt, J.: "Effect of Fracturing Fluid and Its Clean-up on Well Performance," SPE 14514, presented at the Eastern Regional Meeting held in Morgantown, W.V. (Nov. 6–8, 1985), incorporated herein by reference. The line for a dimensionless fracture conductivity of 30 is shown in FIG. 5 (see the dashed line marked with reference numeral 20). The graph of FIG. 5 indicates that a production increase (PI) ratio of 7.5 is attainable with a fracture conductivity of 2,000 md-ft and a fracture length of 667 feet (see intersection point 22).

If the formation permeability is 100 md, and if the curve for dimensionless conductivity of 30 is again considered, creating a fracture length of 33 feet requires a fracture conductivity of 100,000 md-ft as shown in FIG. 6 at point 24. Such conductivity is difficult to attain if not impossible. The program then may opt in this case to use a dimensionless conductivity of 3 (line 26 in FIG. 6), yielding a required fracture conductivity of 10,000 md-ft (see point 28 in FIG. 6). Such fracture conductivity may be attainable using special fracture design procedures (for example, FracPac™ tip screen out).

If turbulent flow is expected to take place inside the fracture (from calculated flow rate), adjustment of designed conductivity should be allowed as known in the art. If turbulent flow conditions exist inside the fracture, the effective fracture conductivity is lower than the actual fracture conductivity. First calculate the potential for turbulence using established techniques. A factor based on degree of turbulence is calculated and the effective fracture conductivity is calculated. The actual flow rate is then calculated. In case of steady state, the calculation is done one time; however, in case of unsteady state, the calculation of turbulent factor is done in steps at different times.

4. Using the digitally encoded mechanical properties of rock (Young's Modulus and Poisson's Ratio), one may easily calculate an approximate fracture width as known in the art. For example, for approximation a two-dimensional model equation may be used (see, for example, Perkins, T. K. and Kern, L. R.: "Width of Hydraulic Fractures," JPT (September 1961) 937-49, incorporated herein by reference; however, other models, such as others developed and presented in the literature in the art, may be used).

5. Using digitally encoded information from published tables or equations, calculate the required proppant deposition (such as in pounds per square feet) given the conductivity that has been determined. Such determination should account for stress carried by the proppant and type(s) and size of proppant(s). Allow for possible proppant embedment, especially in soft formations, and any effect of proppant embedment in filtercake.

Figure 7:
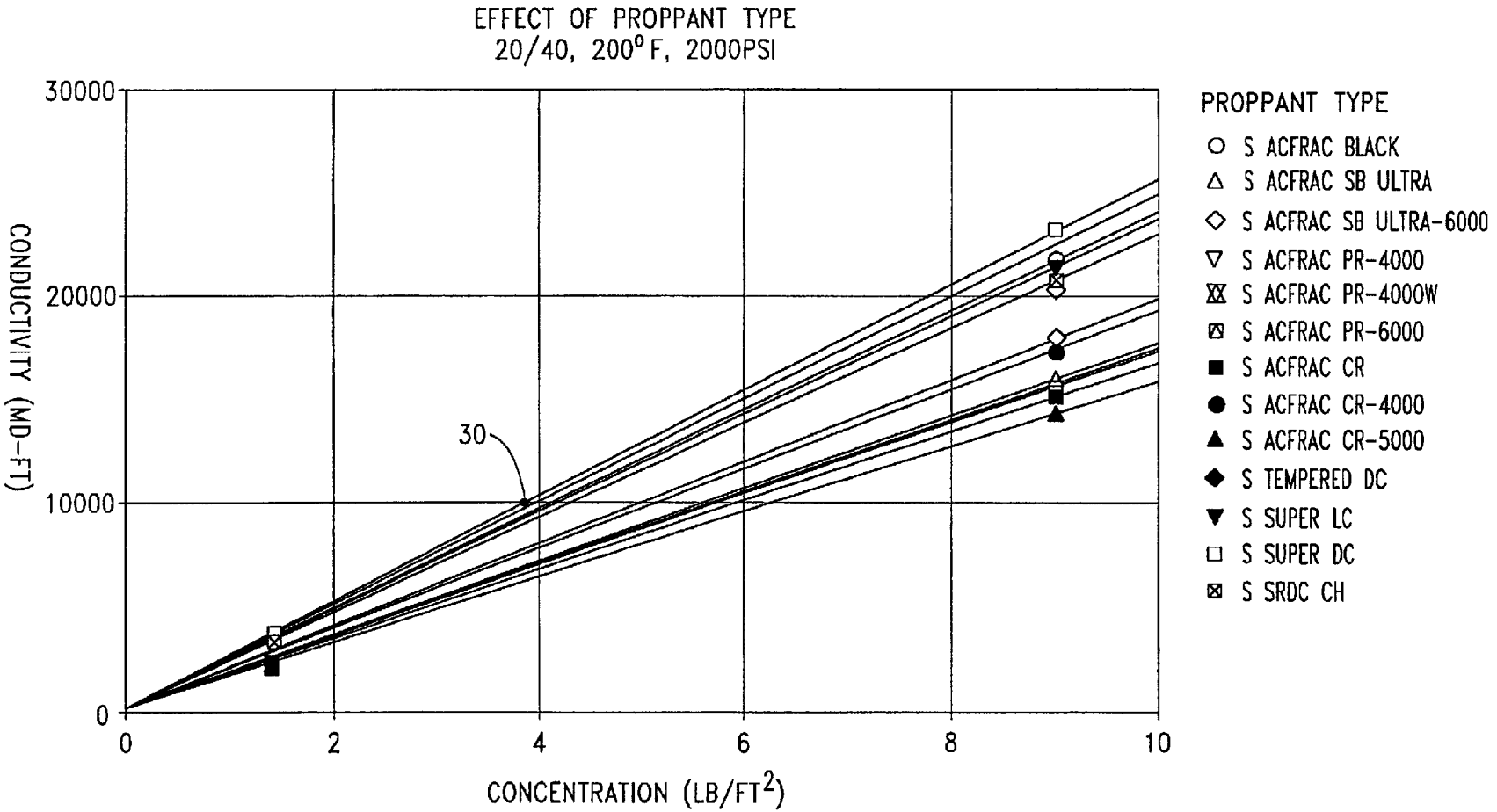
FIG. 7 contains conductivity versus concentration graphs for several different proppant types.
Figure 11:
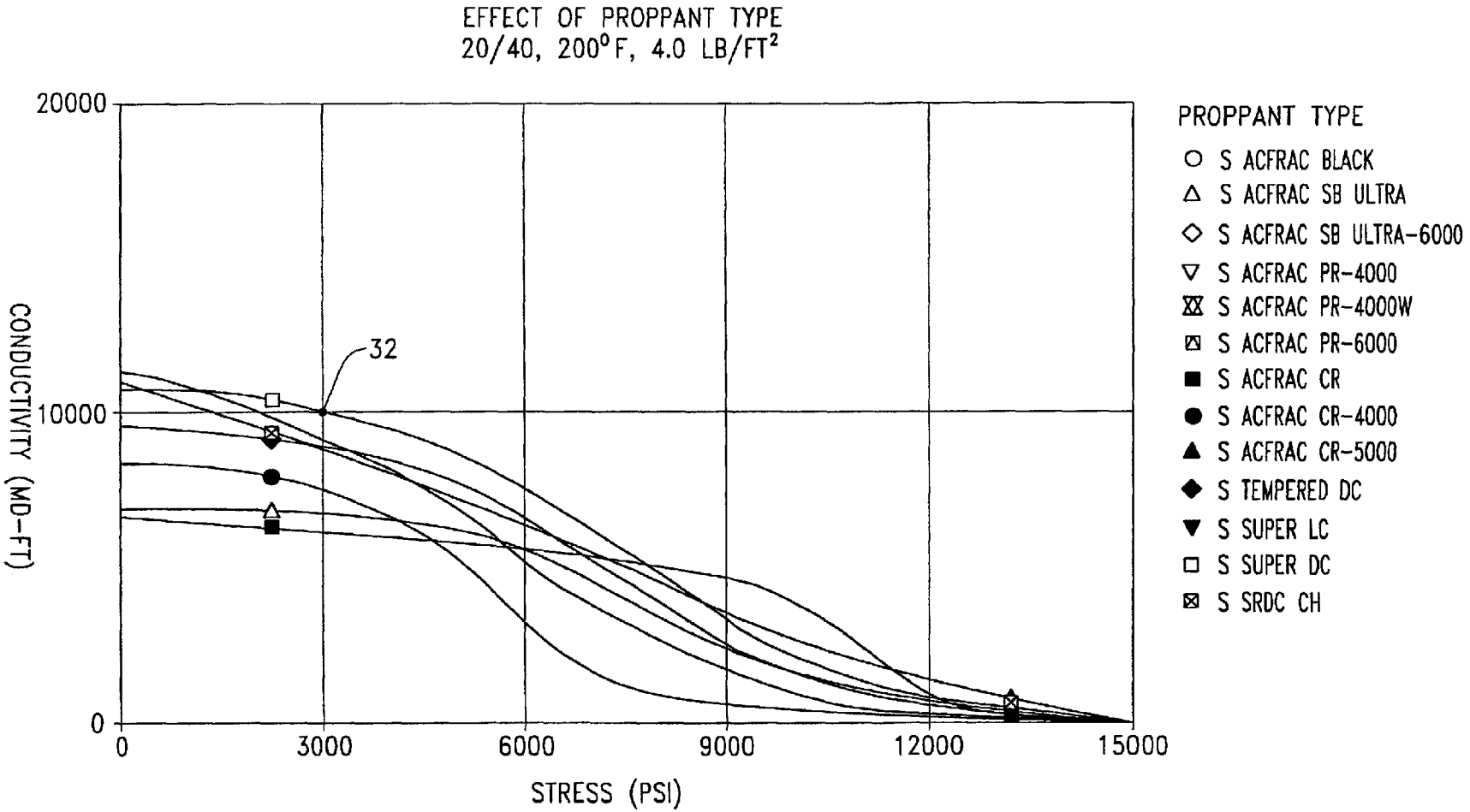
Figure 3:
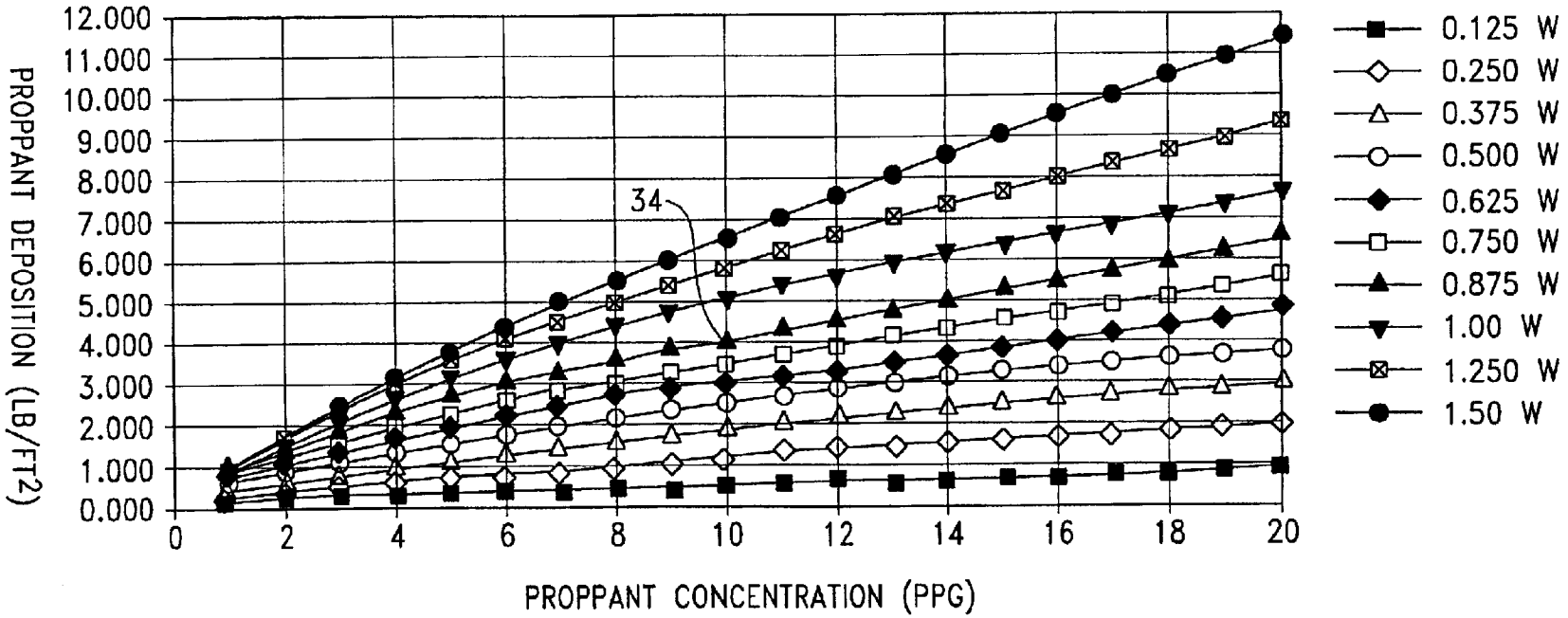

Referring to FIG. 7, the graphs show that different proppants have different disposition requirements at a conductivity of 10,000 md-ft, for example. The one requiring the least amount per square foot for this is Super DC® resin coated proppant indicated at point 30 (slightly less than four pounds per square foot). This material is suitable for a stress characteristic of approximately 3,000 pounds per square inch (psi) at a conductivity of 10,000 md-ft (see point 32 in FIG. 8). So given a calculated desired conductivity, a desired concentration, and a stress parameter, the list of available proppants is quickly narrowed.

6. Using digitally encoded published equations or graphs, such as illustrated in FIG. 9, the required sand concentration in pounds per gallon (lb/gal or ppg) may be calculated for a given width and desired conductivity. For the above example of a proppant deposition of about four pounds per square foot, and a calculated width of 0.875 inch, for example, then FIG. 9 shows that the proppant concentration in the fracturing fluid should be ten pounds per gallon (see point 34 in FIG. 9).

7. Using a temperature calculation model/correlation, calculate downhole temperature of each fluid stage. See, for example: Ramey, Jr., H. J., "Wellbore Heat Transmission,", JPT, April 1962, 427; Wooley, G. R., "Computing Downhole Temperatures in Circulation, Injection, and Production Wells," JPT, September 1980, 1509; Wheeler, J. A., "Analytical Calculations of Heat Transfer from Fractures,", SPE 2494, Improved Oil Recovery Symposium, Tulsa, April 1962; Kamphuis, Davis, and Roodhart, "A New Simulator for the Calculation of the In-Situ Temperature Profile During Well Stimulation Fracturing Treatments", CIM/SPE 90-46, Calgary, Jun. 10–13, 1990; all incorporated herein by reference.

8. Using the calculated temperature, define the best fluid needed to carry the proppant and keep the majority of the proppants in suspension (for example, 70%). Factors that may be considered include leak-off coefficient, closure time, and degradation of fluid viscosity with time. See, for example: Nolte, K. G.: "Fluid Flow Considerations in Hydraulic Fracturing." Paper SPE 18537 presented at the 1988 APE Eastern Regional Meeting, Charleston, W.V., November 1–4; Leal, L. G.: "Particle Motions in a Viscous Fluid" Annual Rev. Fluid Mech. (1980), 12, 435; Cleary, M. P and Fonseca Jr, A.: "Proppant Convection And Encapsulation in Hydraulic Fracturing: Practical Implications of Computer and Laboratory Studies" paper SPE 24825 presented at the 1992 SPE Annual Technical Conference and Exhibition, Washington, D.C., October 4–7; Pearson, J. R. A: "On Suspension Transport in a Fracture Framework for a Mathematical Model" *J. Non-Newtonian Fluid Mechanics* (1994), 54, 503; Economides, M. J. and Nolte, K. G.: "Reservoir Stimulation 3$^{rd}$ Edition", John Wiley and Sons LTD, (2000), pp 8-19–8-22.; Mobbs, A. T. and Hammond, P. S., "SPE Production & Facilities" May 2001, Volume 16, Number 2, pp 112–121; all incorporated herein by reference.

9. If it is found that the designed proppant concentration is higher than could be normally achieved, tip screen out design should be considered. In tip screen out the fracture is designed such that the proppant reaches the tip of the fracture at the time the fracture reaches the desired length. Having the proppant reaching the tip of the fracture, the fracture will stop growing in length. By continuing to inject sand-laden-fluid, the fracture will grow in width (balloon). After the fracture is allowed to close, the sand concentration will be significantly higher than average.

10. Steps 5 through 8 may be reiterated to conclude the best proppant, average proppant concentration, and fluid system for the treatment.

The foregoing preferably is performed using a suitable digital computer programmed to include suitable digital implementations or representations of computational and materials information (for example, suitable programming to permit use of the information and relationships represented in FIGS. 4–9). Preferably, the same computer can be programmed for use in performing the following as well.

To Obtain a Refined Design

The foregoing section describes an implementation of a part of the present invention used to select appropriate materials in a piece-wise method, whereas this next section describes a part of the invention used to combine the materials in a process similar to the first part to do the final optimization of the entire design. That is, the above is done more for materials selection (for example, to consider different materials and then to develop the appropriate list of materials), whereas the following is to fine-tune the design using the lowest cost materials from above. The first run above uses more generic information to limit the materials list and now the various selected materials are run in one or more models such as FracProPT™, FracPro®, StimPlan™, etc. modeling programs. Preferably, this uses the materials in a complete system to run through a 3-D simulator to finalize the optimized design with pumping schedule and the combination of materials to be used. One may have also learned from the foregoing part of the invention that to meet the objective a specialized approach is needed to obtain the desired conductivity and this is where that process will be optimized.

1. Use the initial design determined from above, and the determined desired fracture conductivity. In this example it is 10000 md-ft from FIG. 6. This fracture conductivity is the fracture conductivity at the wellbore, so now a conductivity profile that creates a fracture with constant pressure drop down the fracture is generated. See, for example, U.S. Pat. No. 4,828,028 to Soliman, incorporated herein by reference.

2. Using the mechanical properties of rock (Young's Modulus and Poisson's Ratio), physical properties, zoning of the formation, and calculated in-situ stresses, run a fracture simulator (for example, the FracProPT™ simulation program). The simulator uses the fluid and proppant type or types that were determined in the initial design.

3. Using a temperature calculation model/correlation, calculate downhole temperature. This temperature profile is used to determine the fluid degradation and thus proppant transport and settling to develop the in-situ proppant conductivity. This uses the combination of materials selected in the first section and the model is run with the actual materials to see how the mixtures affect the design of the fracture treatment. This is where different proppant and fluid combinations are analyzed.

4. Using the calculated temperature, define the best fluid needed to carry the proppant and keep the majority (for example, 70%) of the proppants in suspension. Factors that may be considered include leak-off coefficient, closure time, and degradation of fluid viscosity with time and temperature. If the original fluid mixture is insufficient, then more polymer or less breaker will be adjusted to achieve the desired proppant suspension. Like above, the selected fluids and proppants from the first section are run in the different combinations to select the best combination to meet the objective.

5. Determine the feasibility of propped fracture length and width by running a model (for example, the FracProPT™ program) using selected fluid/fluids to determine the effect on the fracture geometry (in other words, to examine whether the fracture geometry (length, height, and width profile) would significantly change from the original design).

6. Calculate the proppant profile inside the fracture, both settled or in suspension. These calculations are made using a simulator such as the FracProPT™ program and it takes into consideration fluid rheology, proppant size, density and concentration. This affects the ideal conductivity if all the proppant is not perfectly transported to the designed location within the fracture, which it will not be (but it should be close if the fluids are adjusted correctly).

7. Determine proppant concentration at each location necessary to produce the non-uniform fracture conductivity, such as based on a set of curves developed by Mohamed Soliman describing the change in conductivity with distance inside the fracture (see U.S. Pat. No. 4,828,028 and "Fracture Conductivity Distribution Studied" referred to above). If the conductivity inside the fracture changes as described by Soliman, then the fracture will behave as if it has a uniform conductivity.

8. Determine initial proppant in slurry and fluid for each location. This is done by taking the fracture and dividing it into segments and adding the fluid that was lost during its transport down the fracture to give the needed concentration at the surface. This calculation is usually done using a frac design simulator such as FracProPT™ and considering the physical properties of the rock, the rheological properties of the fluid and concentration of the proppant in the fluid.

9. Adjust for settled proppant and determine proppant schedule. The fluid degradation may cause some settling and this is where the final fluid mixture is adjusted to achieve the proppant transport needed for the conductivity profile.

10. Steps 4 through 9 may be reiterated to conclude the best proppant, average proppant concentration, and fluid system for the treatment.

11. Using the optimum fracture designs, run a reservoir simulator (SAPHIR, PROMAT, etc.) and predict well performance with and without fracturing and for the different designs that will result from the material selections. The reservoir simulator produces a profile of well productivity for each local optimum fracture design. Based on the chosen economic drivers (see next item) a global optimum is determined.

12. Run an economics model and plot a selected economic parameter such as NPV, Benefit/Cost Ratio, ROI, etc., versus fracture length. This preferably includes performing in the computer an economics analysis of projected resulting production versus a projected cost of performing the treatment.

13. If working with a 3-D design, only concentration against the pay zone is considered. The above design was essentially for a two-dimensional model; however, it may be expanded to a three dimensional situation by considering that the formation consists of a contributing formation and non-contributing formation. The proppant concentration against the contributing formation is the critical factor.

To Obtain Real Time Modification to Design

After the desired fluid and proppant have been determined using the above steps, those materials in suitable quantities are delivered in known manner to the actual well site if they are not already there. Before the fracturing job is performed, however, a pumping or treatment schedule must be determined. This is done during the following steps:

1. Pump mini-frac job with step down test to perform a fluid efficiency test.

2. Determine if and how much near wellbore friction exist.

3. Determine closure, net pressure, and fluid efficiency for formation.

4. Adjust fracture design program (such as FracProPT™) model parameters to match net pressure and leak-off rate from mini-frac.

5. Use fracture design program (such as FracProP™) model design mode to optimize fluid and proppant on location for new model parameters matched in step 4 of this section.

6. Pump treatments using fluid and proppant as per new optimized design in step 5 of this section.

7. Monitor treatment with fracture design program (such as FracProPT™) in real time model to predict fracture growth during treatment.

8. Make adjustments to treatment as required based on model prediction.

In accordance with the foregoing, the method of the present invention thus further comprises measuring, in real time while pumping fluid and proppant, downhole parameters in the well; modifying, in the computer and in response to the measured downhole parameters, the treatment schedule; and continuing the pumping of fluid and proppant in accordance with the modified treatment schedule.

Risk Factor Analysis (Optional)

This step is an optional one and comprises calculating the risk factor associated with running a fracturing treatment. This may include, for example, calculation of uncertainty in creating the optimized length, risk factor due to uncertainty in knowledge of reservoir parameters, risk due to remote but possible failure of hardware, and risk associated with location and operations conditions such as onshore versus offshore operations. As another example, such risk could be as simple as that the area does not have experience applying the selected materials or processes and the next best choice might be the normal technology applied and the risk to benefit would need to be weighed before selecting the most optimum design. It could be, for example, the risk of getting a new product to a remote or third-world country that could cost more than the resulting benefit for going to the optimum design because of logistics, or that the appropriate equipment is not available to apply the technology in a timely manner. Other risk factors can be used.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A computer-aided well completion method, comprising:

performing tests on a subterranean well to obtain data about physical properties of at least one earthen formation traversed by the well, and entering the data into a computer;

determining, in the computer and in response to the data, an initial fracture model having an initial desired fracture length and conductivity for a fracture to be formed in at least one earthen formation traversed by the well, said fracture having an initial conductivity profile selected to optimize production;

determining in the computer and in response to the data and the initial desired fracture length and conductivity, a proppant and a fracturing fluid proposed to be pumped into the well to fracture the earthen formation;

determining, in the computer, a treatment schedule for pumping the fluid and the proppant into the well;

pumping fluid and proppant into the well in accordance with at least part of the treatment schedule;

measuring in real time while pumping fluid and proppant downhole parameters in the well;

modifying, in the computer and in response to the measured downhole parameters, the treatment schedule; and continuing the pumping of fluid and proppant in accordance with the modified treatment schedule.

2. A computer-aided well completion method as defined in claim 1, wherein the first-mentioned pumping fluid and proppant is performed as part of performing a mini-frac job on the well.

3. A computer-aided well completion method as defined in claim 1, wherein the determining steps are performed using neural network processing.

4. A computer-aided well completion method as defined in claim 1, wherein determining the treatment schedule includes performing in the computer an economics analysis of projected resulting production versus a projected cost of performing the treatment.

5. A computer-aided well completion method, comprising:

performing tests on a subterranean well to obtain data about physical properties of at least one earthen formation traversed by the well, and entering the data into a computer;

determining in the computer and in response to the data, an initial fracture model having an initial desired fracture length and conductivity for a fracture to be formed in at least one earthen formation traversed by the well, said fracture having an initial conductivity profile utilizing uniform pressure decline with distance inside the fracture during production;

determining, in the computer and in response to the data and the initial desired fracture length and conductivity, a proppant and a fracturing fluid proposed to be pumped into the well to fracture the earthen formation;

determining, in the computer, a treatment schedule for pumping the fluid and the proppant into the well; pumping fluid and proppant into the well in accordance with at least part of the treatment schedule;

measuring, in real time while pumping fluid and proppant, downhole parameters in the well;

modifying in the computer and in response to the measured downhole parameters, the treatment schedule; and continuing the pumping of fluid and proppant in accordance with the modified treatment schedule.

* * * * *